United States Patent [19]

Marotto

[11] 3,952,789

[45] Apr. 27, 1976

[54] TOP POSITION LOCK FOR VENETIAN BLINDS

[75] Inventor: Anthony F. Marotto, Philadelphia, Pa.

[73] Assignee: Marathon Manufacturing Company, Philadelphia, Pa.

[22] Filed: June 26, 1975

[21] Appl. No.: 590,595

[52] U.S. Cl. ..... 160/168 R; 160/178 C

[51] Int. Cl.[2] ..... E06B 9/30; E06B 9/324

[58] Field of Search ..... 160/168, 173, 178 C, 160/177, 175, 169

[56] References Cited

UNITED STATES PATENTS

| | | | |
|---|---|---|---|
| 2,172,657 | 9/1939 | Haase | 160/178 C UX |
| 2,786,551 | 3/1957 | Bennett | 160/178 C UX |
| 3,799,236 | 3/1974 | Debs | 160/178 C |

*Primary Examiner*—Philip C. Kannan

[57] ABSTRACT

A venetian blind having a top position lock wherein a pull cord extends over and depends from a cord guide between the latter and a freely upwardly shiftable jam member which engages the depending pull cord. The pull cord urges the jam member downwardly away from the guide upon upward slat movement, and the pull cord urges the jam member upwardly into jammed engagement with the cord guide upon downward slat movement. Detent means holds the jam member downwardly except in the top slat position, so that jamming action only occurs with the slats fully raised.

7 Claims, 5 Drawing Figures

FIG. 1
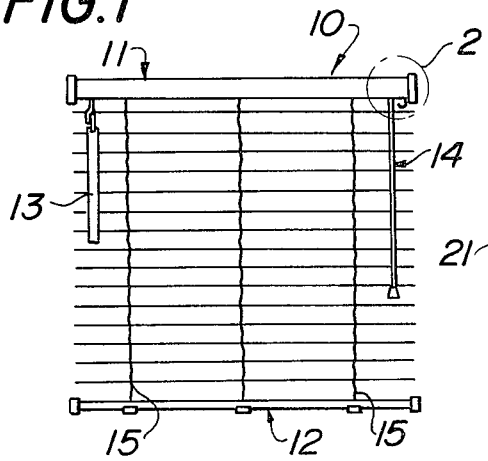
FIG. 2
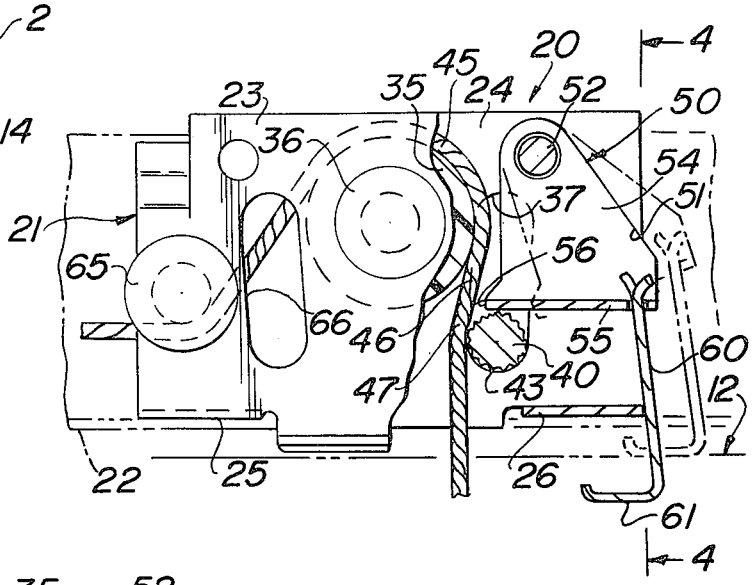
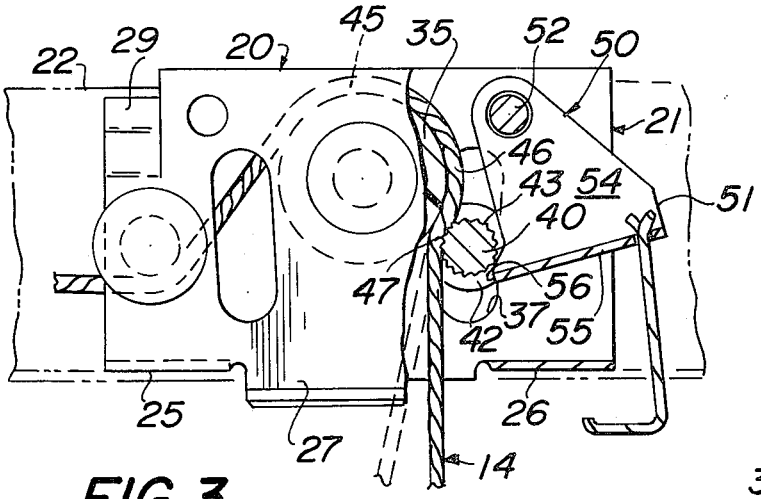
FIG. 3
FIG. 4
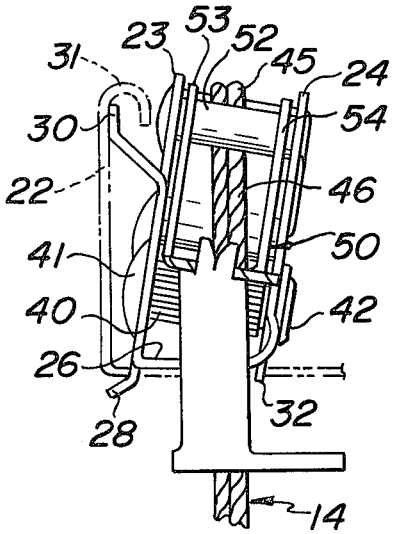
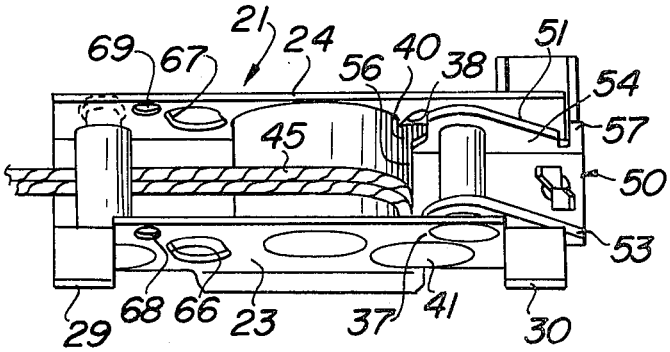
FIG. 5

TOP POSITION LOCK FOR VENETIAN BLINDS

BACKGROUND OF THE INVENTION

As is well known to those versed in the venetian blind art, under certain circumstances it is desired to provide venetian blinds which may be locked upon elevation of the slat assembly to its uppermost position. By this means, apartment houses, office buildings and other similar large buildings are rendered more attractive from the outside, as the haphazard appearance of venetian blinds at a multitude of different slat settings or elevations is avoided.

However, prior art blind assemblies having automatic top position locking have been relatively complex in structure and consequently unreliable in operation, requiring considerable maintenance to assure satisfactory operability.

SUMMARY OF THE INVENTION

It is an important object of the present invention to provide a top position lock for a venetian blind, sometimes called a top lock structure, which is entirely automatic in operation, serving to automatically lock in its top position, and releasable by the conventional pull cord swinging manipulation, which structure is extremely simple in construction for economy in manufacture, ease of assembly, extreme reliability in operation throughout a long useful life, and which requires an absolute minimum of maintenance.

It is a more particular object of the present invention to provide a top lock structure for a venetian blind which greatly reduces the number of parts required, substantially simplifies the structure of required parts. By way of example, the instant invention completely obviates the need for a locking dog or any pivoted cord-locking mechanism whatever, as is required in the prior art device of U.S. Pat. No. 3,799,236.

BRIEF DESCRIPTION OF THE DRAWINGS

FIG. 1 is a front elevational view showing a venetian blind of the present invention with the slat assembly in a released, unlocked or lowered condition.

FIG. 2 is a sectional view, partly broken away and enlarged for clarity, showing the top position lock structure of the present invention, as located in the region "2" of FIG. 1, with the lock released, and a slightly different position being illustrated in phantom.

FIG. 3 is a sectional elevational view similar to FIG. 2, but showing the lock structure in a locked condition with the slats elevated to top position.

FIG. 4 is a sectional elevational view taken generally along the line 4—4 of FIG. 2.

FIG. 5 is a top plan view showing the lock assembly of FIG. 4.

DESCRIPTION OF THE PREFERRED EMBODIMENT

Referring now more particularly to the drawings, and specifically to FIG. 1 thereof, there is shown a venetian blind of the present invention generally designated 10, including a laterally extending upper assembly or head 11, and depending therefrom a slat assembly 12, shown in its lowered position. Tilt actuating means 13 may assume the form of a rotary rod, or other suitable actuating means, as at 13, depending from the head 11 adjacent to one end thereof, say the left-hand end. Also depending from the head 11, say adjacent to the right-hand end, may be elevation or height control means 14, say in the form of a pull cord, which may conventionally include a pair of cord elements suitably secured together, as desired.

The slat assembly 12 is suspended from the head 11 by ladders 15, which may be string ladders as illustrated, or otherwise, and have their upper ends connected within and depending from the head 11. As thus far described, the venetian blind 10 may be essentially conventional.

However, within the head 11, as in the region 2, is a top position lock of the present invention for automatically locking the slat assembly 12 in its top or uppermost position, permitting of selective unlocking and lowering, while precluding locking in any position except the top position.

The top position lock structure is best seen in FIGS. 2–5, there being generally designated 20. The top lock mechanism 20 may include a mounting structure 21 mounted in a top rail or head channel 22. The mounting structure 21 is generally of U-shaped, channel-like configuration, as may be formed of sheet metal, and may include a pair of generally parallel, spaced front and rear walls 23 and 24 inclined upwardly and rearwardly as best seen in FIGS. 4 and 5. The upstanding front and rear walls 23 and 24 are connected together at their lower regions by spaced bottom wall portions 25 and 26 combining to define a bottom wall resting on the bottom of head channel 22. The bottom wall portions 25 and 26 are spaced apart to define therebetween an opening 27, for a purpose appearing presently, and a forwardly declining holding tab or extension 28 projects from the lower edge of front mounting structure wall 23 for engagement through a bottom opening in the head channel 22. The front mounting structure wall 23 is further formed in its upper region with a pair of laterally spaced, forwardly and upwardly extending holding tabs 29 and 30 for holding engagement with the head channel 22, as in an upper edge curl 31, see FIG. 4. The rear mounting structure wall 24 may be provided at its lower edge with a downwardly projecting holding tab or extension 32, see FIG. 4, for depending holding engagement through the bottom of head channel 22, so that the mounting structure is effectively maintained in position within the head 11 without the need for fastener elements, such as rivets, or the like.

Generally over the bottom wall opening 27 of the mounting structure 11, extending forwardly and rearwardly between the front and rear mounting structure walls 23 and 24, is a cord guide, roller or wheel 35, which may be generally cylindrical, having its axis extending generally perpendicular to and between front and rear mounting structure walls 23 and 24, being rotatably supported therebetween by a shaft, axle or rivet 36. The roller or rotatable guide 35 may be suitably fabricated, as of plastic, and is freely axially rotatably supported by the rivet or pin 36. In addition, the supporting rivet or pin 36 may structurally reinforce and rigidify the generally U-shaped mounting structure 21.

Formed in the front and rear mounting structure walls 23 and 24 are respective, parallel spaced, opposed, facing guideways or slots 37 and 38 which extend from a position at least partially below or under the roller or guide 35, on one side of the latter, the right-hand side as seen in the drawings, obliquely upwardly and rightwardly or outwardly, generally toward and approximately tangent to the roller guide. That is, the slots or guideways 37 and 38 extend, in their facing relation, from a position below the guide roll 35 adjacent to one side of the latter obliquely upwardly toward the guide roller 35 terminating proximate to and alongside of the latter.

A jam member, pin or cylindrical catch 40 may extend generally horizontally, forwardly and rearwardly through the opposed, facing pair of guideways or slots 37 and 38, being freely rotatable and shiftable along the slots. That is, the cylindrical jam member or pin 40 has its axis generally parallel to the axis of guide roller 35 and is shiftable from a lowermost position in slots 37 and 38, as seen in FIGS. 2 and 4, obliquely upwardly toward and generally along a tangent to the guide roller 35, say to the position shown in FIG. 3. Enlarged forward and rearward heads or ends 41 and 42 may be provided on respective opposite ends of jam member or pin 40, respectively outwardly of the front and rear mounting structure walls 23 and 24, to retain the jam member in position within the slots 37 and 38 extending between the mounting structure walls, while permitting free axial rotation and translation of the jam member along the slots. Advantageously, the jam member 40 may be circumferentially roughened or knurled, such as by serrations 43, best seen in FIGS. 2 and 3.

The pull cord 14 extends from the slat assembly 12, laterally within the head 11, outwardly over the guide roller 35, as at 45, being trained outwardly over and downwardly along the outer side of the guide roller, as at 46, whence the pull cord depends between the guide roller and the jam member 40, as at 47. It will best be seen in FIGS. 2 and 3, that the flexible elongate pull cord 14, at its region 47 passes inwardly of, over and in engagement with the serrated or frictional surface 43 of freely shiftable jam member 40. Thence, the pull cord 14 depends freely in front of the slat assembly 12, to its free end.

A detent or latching mechanism is generally designated 50, and includes a freely rotatably shiftable or swingable, generally U-shaped detent member 51 located at an elevation above and overlapping the upper regions of slots 37 and 38. More specifically, the detent member 51 has its upper end freely pivotally supported, as by a rivet or pin 52 extending generally forwardly and rearwardly between mounting structure walls 23 and 24 at a location over or generally above the upper ends of slots 37 and 38. The pin 52 may be generally parallel to the axes of guide roll 35 and jam member 40. The generally U-shaped detent 51 has parallel, spaced front and rear side walls 53 and 54 rotatably receiving, at their upper ends, pin 52 and depending therefrom to their lower regions, where they are joined by a generally forwardly and rearwardly extending connecting or bottom wall 55. The detent member 51 is configured to swing gravitationally clockwise to a limiting position with the inner end or edge 56 (the left-hand edge as seen in the drawings) of bottom wall 55 extending at least beyond the center line of slots 37 and 38, and also beyond the center line of pin 40 when the latter is in its lower, rest position of FIG. 2. Such clockwise movement of detent 51 is limited by a stop finger 57 extending rearwardly for abutting engagement with the end edge of rear mounting structure wall 24. This condition is shown in FIG. 5.

The detent means 50 may further include shifting means 60, say in the form of an arm or trigger depending from a laterally outward region of detent bottom wall 55, remote from pin 40 and cord guide 35, and terminating at its lower end in an abutment head 61. The detent shifting arm 60 and its lower end abutment head 71 depend, in the solid line position of FIG. 2, to a position in the path of upward movement of the slat assembly 12. By this means, upward movement of the slat assembly 12 to its top position effects engagement with the detent shift means 60 to elevate the latter and swing detent 51 counterclockwise, to the phantom position shown in FIG. 2.

In operation, slat elevation to its top position, the phantom position shown in FIG. 2, withdraws the detent 51 out of its position where inner edge 56 extends across the center line of slots 37 and 38, and over the center of pin 40. In this condition, with the pull cord 45 in its fully downwardly pulled condition in frictional engagement with the freely shiftable jam member 40, incipient upward movement of the pull cord upon release, as effected by incipient gravitational downward movement of the slat assembly, causes the jam member 40 to shift upwardly along its constrained path of slots 37 and 38 to the position shown in FIG. 3. That is, the jam member 40 moves upwardly, obliquely toward the cord guide 35 and effectively jams the cord between the guide and jam member, so that further downward movement of the slat assembly is prevented. This top lock position is shown in FIG. 3.

In order to release the slat assembly from its top locked position of FIG. 3, it is only necessary to swing the pull cord 14 leftward, to the phantom position, to release the jam member 40 for gravitational falling past detent 51 to its lowermost, slat assembly releasing or freeing position of FIG. 2. Thence, upon release of the pull cord 14, the slat assembly is free to descend. In this released slat assembly condition, the solid line position of FIG. 2, it will be observed that the detent member 51, by its gravitational movement, swings over the jam member or pin 40. Hence, free up and down movement of the slat assembly by the pull cord 14 may be freely effected, without impairment by the jam member 40, the latter being held downwardly by limiting engagement with the under side of detent bottom wall 55. It is only in the topmost slat position that the detent member is shifted outwardly or counterclockwise, as described hereinbefore, to release the jam member for its jamming action.

Further rigidifying the channel-like mounting structure 20 may be a generally forwardly and rearwardly extending pin or rivet 65 extending between the front and rear walls 23 and 24, at the innermost or leftward end thereof. Also, an additional pair of upstanding, inclined, parallel spaced, facing slots 66 and 67 may be formed in the respective front and rear walls 23 and 24, on the other, leftward side of the guide roll 45, similar to the guide slots 37 and 38, while front and rear rivet holes 68 and 69 may be provided adjacent to and above the upper ends of respective slots 66 and 67. The slots 66, 67 and holes 68, 69 are provided to enable the mounting structure 21 to be employed in a left-hand operated blind, as well as a right-hand operated blind. In a left-hand operated blind, the jam member 40 and detent means 50 would be mounted in the slots 66, 67 and holes 68, 69, and operate in the same manner as described hereinbefore, being only of opposite hand.

From the foregoing, it is seen that the present invention provides a top position lock structure for a venetian blind which is extremely simple in design, requiring a minimum of relatively staunch and sturdy parts for high reliability in operation throughout a long useful life, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A top position lock for a venetian blind including a head and a depending slat assembly, said top position lock comprising: a mounting structure in the head, a cord guide carried by the mounting structure, a jam member shiftably carried by the mounting structure for movement between a lower free position spaced below said guide and along a path obliquely upwardly toward said guide to an upper locking position proximate to said guide, a pull cord connected to said slat assembly for raising and lowering the latter upon respective downward and upward cord movement, said pull cord being trained over said guide and depending gravitationally between said guide and jam member in engagement with the latter, downward cord movement in engagement with said jam member urging the latter downwardly to its free position and upward cord movement in engagement with said jam member urging the jam member upward to jam said cord against said guide, detent means shiftably carried by said head extending across said jam member path in upward limiting engagement with said jam member to maintain the latter in its free position, and detent shifting means operative to shift said detent means out of said path to release said jam member for upward movement to jam said cord against said guide, said detent shifting means depending into the path of said slat assembly at its top position for release of said jam member to its upper position only when said slat assembly is fully raised.

2. A top position lock according to claim 1, said guide means comprising a generally horizontal roller, and said jam member comprising a generally horizontal pin having its axis generally parallel to that of said roller along its path of movement.

3. A top position lock according to claim 2, said pin having frictional surface for enhanced frictional engagement with said cord.

4. A top position lock according to claim 1, said detent means being freely swingably carried by said mounting structure for gravitational movement into limiting position over said jam member when the latter is in its free position.

5. A top position lock according to claim 4, said detent shifting means comprising an operating element depending from said detent means remote from said jam member for engagement with the slat assembly to swing said detent means against gravity out of said limiting position.

6. A top position lock according to claim 5, said detent means being swingable about a generally horizontal axis, and said jam member comprising a generally horizontal roller pin, said detent means being shiftable at least beyond the center of said pin for rolling engagement of the pin with said detent means.

7. A top position lock according to claim 1, said mounting structure comprising a channel, and said guide comprising a roll extending across and rotatably mounted in said channel, and said jam member comprising a pin extending across and axially rotatably and transversely slidably mounted in said channel.

* * * * *